US010779565B2

(12) United States Patent
Caprini et al.

(10) Patent No.: US 10,779,565 B2
(45) Date of Patent: Sep. 22, 2020

(54) FILTER MANUFACTURING APPARATUS

(71) Applicant: PHILIP MORRIS PRODUCTS S.A., Neuchatel (CH)

(72) Inventors: Gianni Caprini, Zola Predosa (IT); Pietro Davide La Porta, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 158 days.

(21) Appl. No.: 15/778,250

(22) PCT Filed: Nov. 25, 2016

(86) PCT No.: PCT/EP2016/078774
§ 371 (c)(1),
(2) Date: May 23, 2018

(87) PCT Pub. No.: WO2017/093131
PCT Pub. Date: Jun. 8, 2017

(65) Prior Publication Data

US 2018/0338524 A1 Nov. 29, 2018

(30) Foreign Application Priority Data

Nov. 30, 2015 (EP) ..... 15196945

(51) Int. Cl.
*A24D 3/02* (2006.01)

(52) U.S. Cl.
CPC ..... *A24D 3/0233* (2013.01); *A24D 3/022* (2013.01)

(58) Field of Classification Search
None
See application file for complete search history.

(56) References Cited

U.S. PATENT DOCUMENTS 2,796,810 A 6/1957 Muller
3,455,766 A * 7/1969 Berger ..... A24D 3/0212 156/433

(Continued)

FOREIGN PATENT DOCUMENTS

GB 1169932 11/1969

OTHER PUBLICATIONS

PCT Search Report and Written Opinion for PCT/EP2016/078774 dated Mar. 2, 2017 (11 pages).

*Primary Examiner* — Dennis R Cordray
(74) *Attorney, Agent, or Firm* — Mueting Raasch Group

(57) ABSTRACT

The present invention relates to a filter manufacturing apparatus comprising: • a feed path adapted to continuously feed a filter material along a longitudinal transport direction; • a forming device connected to a terminating end of the feed path and adapted to form the filter material into a continuous filter body and to deliver the formed continuous filter body, the forming device including: • a tubular element (8) adapted to allow the filter material to pass therethrough to form the filter tow material into the continuous filter body; and • a steam generator (9) adapted to produce steam, the steam generator being in fluid communication with the tubular element to supply steam to the filter material; • a drain channel (10) in fluid communication with the tubular element adapted to drain fluid from the tubular element; • a valve adapted to open and close the drain channel so as to allow or block discharge of fluid from the tubular element.

9 Claims, 3 Drawing Sheets

(56) References Cited

U.S. PATENT DOCUMENTS

| | | | | | |
|---|---|---|---|---|---|
| 3,552,400 | A | * | 1/1971 | Berger | A24D 3/0208 131/339 |
| 3,819,435 | A | * | 6/1974 | Roberts | A24D 3/0233 156/62.2 |
| 4,007,668 | A | * | 2/1977 | Holden | A24D 3/0283 493/4 |
| 4,055,108 | A | * | 10/1977 | Holden | A24D 3/0283 493/4 |
| 4,925,602 | A | * | 5/1990 | Hill | D02G 1/12 264/454 |
| 2013/0231232 | A1 | | 9/2013 | Giannini | |

* cited by examiner

FILTER MANUFACTURING APPARATUS

This application is a U.S. National Stage Application of International Application No. PCT/EP2016/078774 filed Nov. 25, 2016, which was published in English on Jun. 8, 2017, as International Publication No. WO 2017/093131 A1. International Application No. PCT/EP2016/078774 claims priority to European Application No. 15196945.8 filed Nov. 30, 2015.

The present invention relates to an apparatus for the production of filters for aerosol-forming articles, and in particular, but not exclusively, for the production of non-wrapped filter.

It is known in the tobacco industry to make paperless filter rods—also called non-wrapped filters or acetate (NWA)—using a continuous strip of filtering material, normally cellulose acetate, which is continuously fed through an impregnation station, at which the strip is impregnated with a plasticizer, for example triacetin, and is then transformed, by means of pressurized air, into a generally cylindrical tow band, which is caused to advance along a longitudinal through channel of a forming beam comprising a first portion, in this case a stabilization portion, and a second portion, in this case a drying portion. Along the first portion, the hardening substance in the tow band is caused to react by means of heat, such as blowing steam, or microwave. Along the second portion, the tow band, previously heated or moistened, is dried and cooled so as to come out of the forming beam in the form of a continuous rod having a determined stable section and relatively high axial rigidity.

This continuous rod is hence preferably fed, again with continuous motion, to a cutting station to be cut into filter segments of determined length.

The process in which the filter material is treated with steam in order to harden the same and then to shape it into a continuous relatively rigid rod is a relatively delicate process and a rather high waste of material is obtained.

There is therefore a need of an apparatus to produce a filter component in which the amount of filter material waste is minimized. The filter material is a rather expensive material and it is desirable to discard as little as possible of it. Further, the minimization of material waste is preferably obtained without a substantive redesign of the filter apparatus.

The invention is relative to a filter manufacturing apparatus comprising a feed path adapted to continuously feed a filter material along a longitudinal transport direction; a forming device connected to a terminating end of the feed path and adapted to form the filter material into a continuous filter body and to deliver the formed continuous filter body, the forming device including: a tubular element adapted to allow the filter material to pass therethrough to form the filter tow material into the continuous filter body; and a steam generator adapted to produce steam, the steam generator being in fluid communication with the tubular element to supply steam to the filter material. Further, the apparatus of the invention comprises a drain channel in fluid communication with the tubular element adapted to drain fluid from the tubular element and a valve adapted to open and close the drain channel so as to allow or block discharge of fluid from the tubular element.

Despite all precautions being taken to eliminate the water from the steam which is fed to the tubular element, the steam is often steam supersaturated with micro-drops of suspended water. The greater the steam flow that hits the filter material band which is present within the tubular element, the greater the number of micro-drops of water that may penetrate into the filter material band. All water drops that penetrate into the filter material band generate a moisture point inside the filter material band itself. This moisture may lead to a rejection of the filter material or to a relatively long further processing time because the elimination of the moisture requires relatively long drying time. According to the invention, the provision of a discharge channel which allows discharging the water droplets which may condense into the tubular element allows minimizing the amount of discarded filter material.

The filter material may comprise any suitable material or materials. Examples of suitable materials include, but are not limited to, cellulose acetate, cellulose, reconstituted cellulose, polylactic acid, polyvinyl alcohol, nylon, polyhydroxybutyrate, polypropylene, paper, thermoplastic material, such as starch, non-woven materials and combinations thereof. One or more of the materials may be formed into an open cell structure. Preferably, the filter material comprises cellulose acetate tow.

The filter material may include additional material, either in a final filter segment or in one or more additional elements incorporated in the filter. For example, the additional material may be incorporated into fibrous filter tow of the filter segment or in an additional filter element. For example, the filter material may include a sorbent material. The term "sorbent" refers to an adsorbent, an absorbent, or a substance that may perform both of these functions. The sorbent material may comprise activated carbon. The sorbent may be incorporated into the filter segment in which the capsule is embedded. More preferably, however, the sorbent is incorporated into an additional filter element upstream of the filter segment. Alternatively or additionally, the filter material may include an adhesive, a plasticizer or flavor release agent, or a combination thereof.

Preferably, the filter material includes a plasticizer, which has the function of a bonding constituent. In non-wrapped filters, as mentioned, the density or stiffness of the filter material needs to be higher than in standard wrapped filters due to the fact that there is no restraint action by the wrapping paper on the filter material. The filter material therefore, when formed in a rod-like shape, needs to keep a well-defined shape, with a substantially fixed diameter, without the aid of any additional external material.

A stiffer filter material may be needed not only in case of non-wrapped filters, but also in the realization of other filter components, such as hollow filter plugs. In hollow filters components, the component includes a through hole which weakens the overall structure of the component itself, such as the filter plug. In order to avoid deformations of the hollow filter component, for example by compression of the filter, it is preferred that the material in which the hollow filter is realized is stiffer than the material in which a standard filter plug is formed. For this purpose, a procedure similar to that used for the production of non-wrapped filters is preferably used also for the production of hollow filters, which can be wrapped or not.

The continuous filter body produced with the apparatus of the invention may be then cut in portions to form filter components, which may therefore be wrapped or non-wrapped.

Filters realized with the apparatus of the invention may advantageously be used in aerosol-forming articles.

Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material, tobacco extract, or other nicotine source, without combustion or heating. Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenisheable or replaceable aerosol forming substrate.

The apparatus for manufacturing filters comprises a feed path to transport the filter material along a transport direction.

In order to shape the filter material, which preferably includes a plasticizer, into a continuous rod further used for the production of filters, a forming device connected to a terminating end of the feed path and adapted to form the filter material into a rod-shaped continuous filter body and deliver the formed continuous filter body is used. The forming device comprises a tubular element adapted to allow the filter material to pass therethrough to form the filter material into the continuous filter body. The inner walls of the tubular element preferably define the outer surface of the continuous filter body and preferably determine, among others, its diameter. The inner walls of the tubular element "compress" the filter material into a rod. Further, in order to render the filter material stiff and with a substantially constant shape, a heat source adapted to heat the filter material passing in the tubular element is also provided, so that the possibly present bonding material, such as the plasticizer possibly present within the filter material, provides for the bonding among the fibers of the filter material.

Plasticizers are additives that increase the plasticity or fluidity of a material.

As used herein, the term "rod" is used to denote a generally cylindrical element of substantially circular, oval or elliptical cross-section.

The heat source is a steam source such as a water steam source, which sprays or otherwise injects steam inside the tubular element.

In order to discharge water from the tubular element, water that may form due to condensation of the steam, an aperture is formed in the tubular element, for example an aperture is formed in the inner surface of a through hole of the tubular element. The aperture is in fluid communication with a drain channel which channels the fluid which may condense inside the tubular element and discharge it outside the tubular element. In order to control the pressure and the amount of steam inside the tubular element, the aperture and the discharge are not always possible. A valve is provided in order to open and close the discharge of water from the drain channel.

Allowing a spillage of water from the tubular element improves the dryness of the interior of the tubular element and minimizes the risk of wetting of the filter material passing through the tubular element. The amount of steam and pressure inside the tubular element, parameters which are relevant for a good hardening of the filter material, can still be controlled thanks to the presence of the valve which determines when the discharge of fluid takes place.

Preferably, the tubular element includes an inner peripheral surface adapted to be in contact with the filter material and wherein the drain channel has an end opened in the inner peripheral surface of the tubular element to drain condensed liquid from the interior of the tubular element. The filter material is transported within the tubular element, where, due to the provision of the steam, is hardened in order to form an axially "rigid" continuous filter body. The filter material inside the tubular element is in contact with an inner surface of the tubular element. Preferably, in the inner surface an aperture is present from which the drain channel departs. The valve is preferably located at the end of the drain channel, where it meets the tubular element.

Preferably, the tubular element includes an inner peripheral surface adapted to be in contact with the filter material and a condensate chamber in fluid communication to the inner peripheral surface, and wherein the drain channel has an end opened in the condensate chamber to drain condensed liquid from the interior of the condensate chamber. The drain channel may not open directly inside the tubular element, but it may drain water from a condensate chamber, in fluid communication with the tubular element. The condensed fluid in the tubular element flows into the condensate chamber, for example by means of an opening into the inner surface of the tubular element. The condensate chamber in turn may include an additional opening, for example in a bottom surface of the chamber, from which an end of the drain channel departs.

Advantageously, the drain channel includes a second end fluidly connected to a drain tank. The condensed water removed through the drain channel from the tubular element or the condensate chamber is preferably discharged in a tank, for example located at a lower portion of the filter manufacturing apparatus.

Preferably, the valve is configured to open and close the drain channel at a predetermined frequency. The valve to open or closed the connection between the inside of the tubular element and the drain channel may be commanded automatically. For example, the valve can be opened and closed at a given frequency. The valve may be also manually opened by an operator. Preferably, the valve may be opened when fluid, such as water, has been detected inside the tubular element or in the condensate chamber, and may be kept closed when only steam is detected inside the tubular element, so that it is preferably avoided that the valve is open when there is just steam in the tubular element.

Preferably, the forming device includes a pressure sensor apt to measure a pressure within the tubular forming element. A control of the pressure inside the tubular element may therefore take place, for example releasing steam if the pressure is too high.

Preferably, the tubular element comprises a plurality of separated tubular elements, the drain channel being in fluid communication with a first of the plurality of separated tubular elements in the longitudinal transport direction of the filter material. Advantageously, the filter manufacturing apparatus comprises a cooling section located downstream the forming device to cool down the hollow rod-shaped filter body. In the forming device, heat is transferred to the continuous filter body in order to bind the filter material due to the plasticizer presence. In order to speed up the process of filter formation, the heat from the filter body needs to be dissipated as quickly as possible in order to obtain a final filter body apt to be further processed. In order to cool the filter body as quickly as possible, a cooling section is provided. The cooling also improves the surface quality of the filter body. Cooling of the hollow filter body downstream of the forming device may be performed with an air flow at room temperature, for example in a pressure range of about 0.4 bar to about 1 bar, more preferably at about 0.5 bar.

Preferably, the filter manufacturing apparatus comprises a wrapping section located downstream the forming device to wrap the hollow filter body in a wrapping sheet. Advantageously, the hollow filter body exiting the forming device is wrapped in wrapping sheet, such as wrapping paper, so that its diameter, which has been checked by the diameter measuring device, cannot further change or can change only of a very limited amount.

More preferably, the wrapping section includes a glue nozzle to distribute glue onto the wrapping sheet so as to close the wrapping sheet around the hollow filter body.

Advantageously, the filter manufacturing apparatus comprises a heating section located downstream the wrapping section to heat up the wrapped hollow filter body. The heating section preferably provided in a location downstream the glue nozzles distributing glue on the wrapping sheet. The glue is preferably used in order to close the wrapping sheet around the filter body firmly, so that it does not "re-open" again. Preferably cold glue is used, which needs heat in order to correctly connect together different portions of the wrapping sheet. Cold glues are commonly water-based solutions. The adhesive solids are dissolved in water, usually by cooking. A bond is formed when almost all of the water is lost via penetration or absorption into substrates, for example by means of heating.

Advantageously, the filter manufacturing apparatus comprises a plasticizer addition unit arranged upstream an inlet of the tubular element and adapted to spout a plasticizer to add the plasticizer to the filter material. In order to obtain a substantially rigid filter body at the outlet of the forming device, a plasticizer is used in order to impregnate the filter fibers and to harden the latter when heat is provided.

Advantageously, the tubular element comprises a tapered portion, so that its internal diameter decreases along the longitudinal transport direction. The tapered portion compresses the filter material so that a rod can be formed by pressure of the inner wall of the tubular element.

The invention will be further described, by way of example only, with reference to the accompanying drawings in which.

Figure 1:
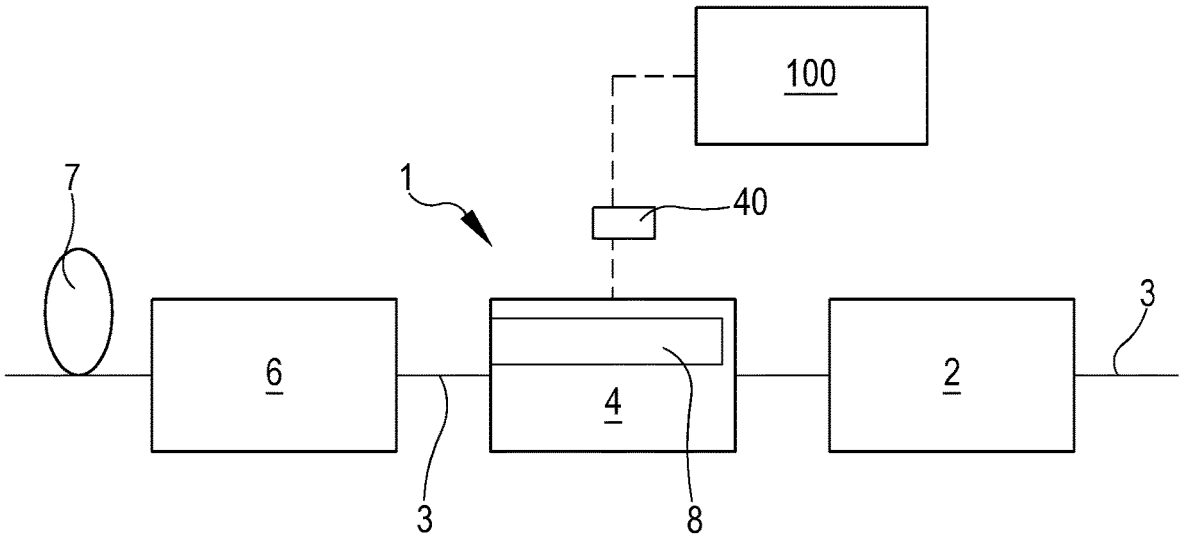
FIG. 1 is a schematic view of an apparatus for forming a filter according to the invention.

Numeral 1 in FIG. 1 indicates an apparatus as a whole, for producing filter rods (not shown) or filters components, preferably for aerosol-generating articles.

Apparatus 1 comprises a transport device 3 to transport along a transport or feeding direction filter material, for example cellulose acetate or filter tow. Further, the apparatus 1 includes an inlet unit 2 adapted to form a continuous stream or strip of filter material, moistened with a hardening fluid or plasticizer, such as triacetin. The filter material is fed to the inlet unit 2 by the transport device 3. The moistening of the filter material with plasticizer takes place in a plasticizer unit, not shown in the drawings and known in the art. The plasticizer unit is located upstream the inlet unit 2. Downstream the inlet unit 2, the apparatus includes a rod forming unit 4, arranged in series to the inlet unit 2 and adapted to receive the flow or band of filter material and to cause the hardening material to react to transform the filter material into a continuous axially rigid rod filter.

Advantageously, the apparatus 1 further includes a wrapping unit 6, to wrap the hollow rod filter in a wrapping paper 90. Further, the apparatus may comprise a cutting unit 7, normally a rotating cutting head of known type, arranged downstream of the rod forming unit 4 and wrapping unit 6 and adapted to cut the hollow filter rod crosswise into filter segments (not shown). The desired length of the units in which the filter body is cut is for example obtained with the assistance of a measurer apparatus (also not shown). The cut units are made available in following processing steps or are buffered.

Wrapping unit 6, transport device 3 and cutting unit 7 are known in the art and not further detailed below.

Figure 4:
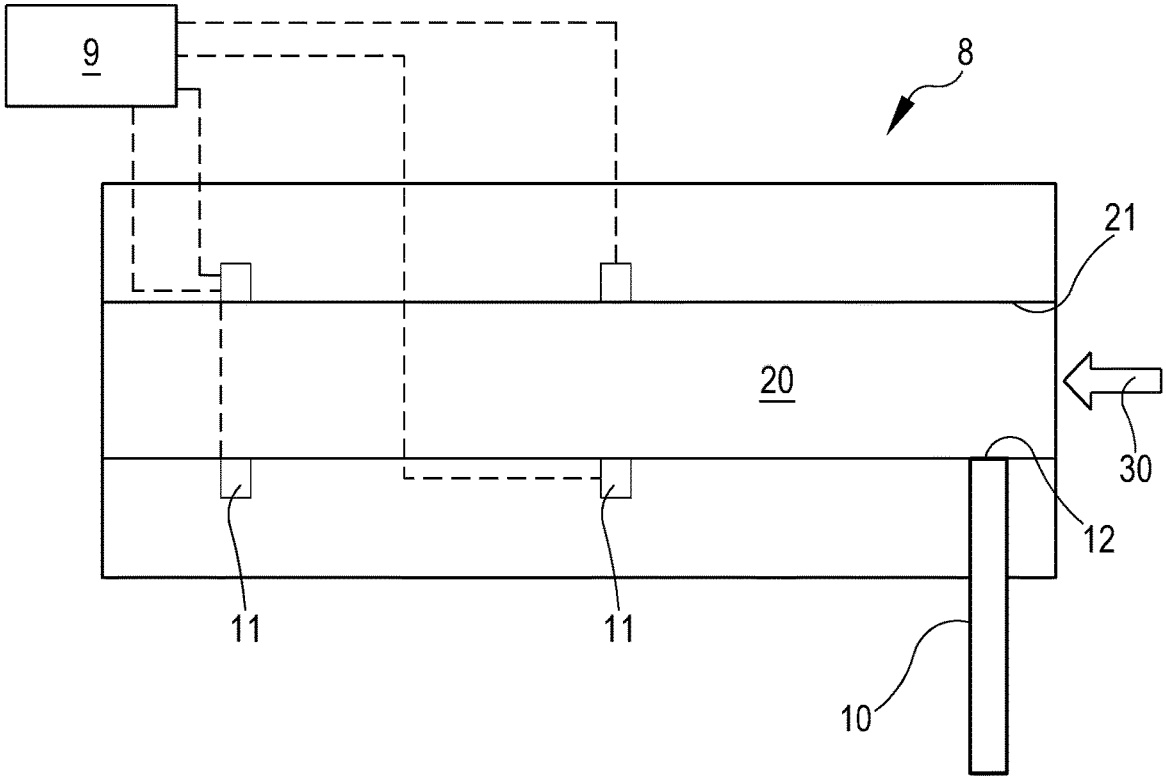
FIG. 4 is a schematic lateral view in section of an element of the apparatus of FIG. 1.

The rod forming unit 4 comprises a tubular element 8, shown in an enlarged view in FIG. 4, adapted to receive the filter material saturated with hardening material, for example along the arrow 30 depicted in FIG. 4 which is the transport direction of the transport device 3, and to shape the filter material crosswise so as to transform it into a moist, generally cylindrical filter body and to advance the tow body in the feed direction of the mentioned arrow to the further components of the apparatus 1.

Preferably the filter material is pushed inside the tubular element 8 along arrow 30 by means of a fluid jet, for example a pressurized air jet, generated by a pressurized fluid generator (not shown in the drawings).

Tubular element 8 defines a through hole 20 through which the filter material can pass. Preferably, the through hole 20 comprises an inner surface 21 which compresses the filter material to form a substantially cylindrical rod-like shaped continuous strip of material. Further, preferably the tubular element 8 includes a steam generator 9 comprising one or more nozzles 11 which can emit steam in the interior of the tubular element 8, that is, in the through hole 20. The steam can harden the plasticizer present in the filter material and transform it into the substantially rigid filter rod or body.

The apparatus 1 further comprises a drain channel 10 which is in fluid communication with the tubular element 8. The drain channel 10 is apt to drain fluid, such as water, which may condense inside the tubular element, so that the filter material flowing into the tubular element 8 does not get humid due to the fluid droplets. In the embodiment of FIG. 4, the drain channel 10 includes an aperture 12 in the inner surface 21 of the tubular element 8. The drain channel is opened and closed by means of a valve 40.

Figure 5:
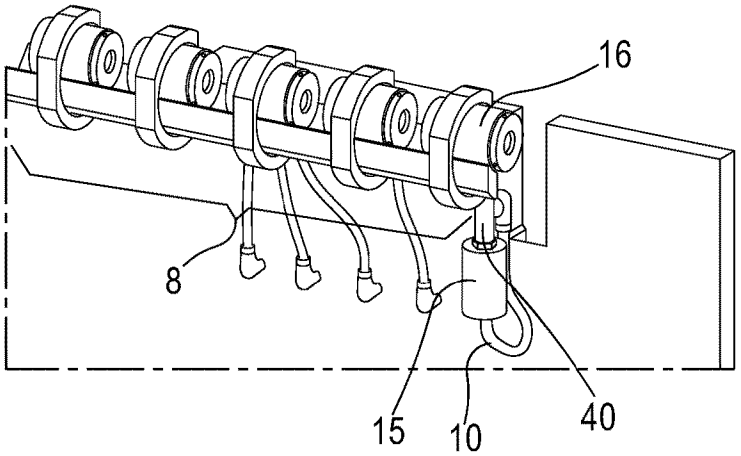
FIG. 5 is a perspective view partially exploded of a different embodiment of the element of FIG. 4.
Figure 2:
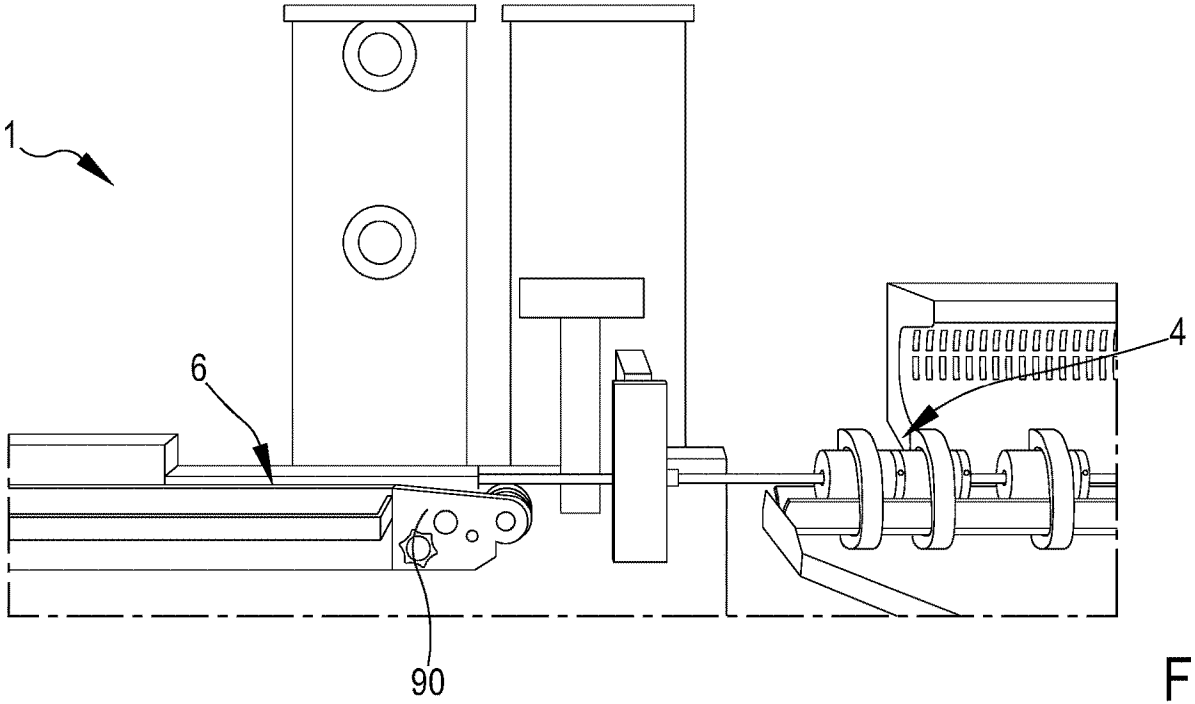
FIG. 2 is a perspective view of a portion of the apparatus of FIG. 1.
Figure 3:
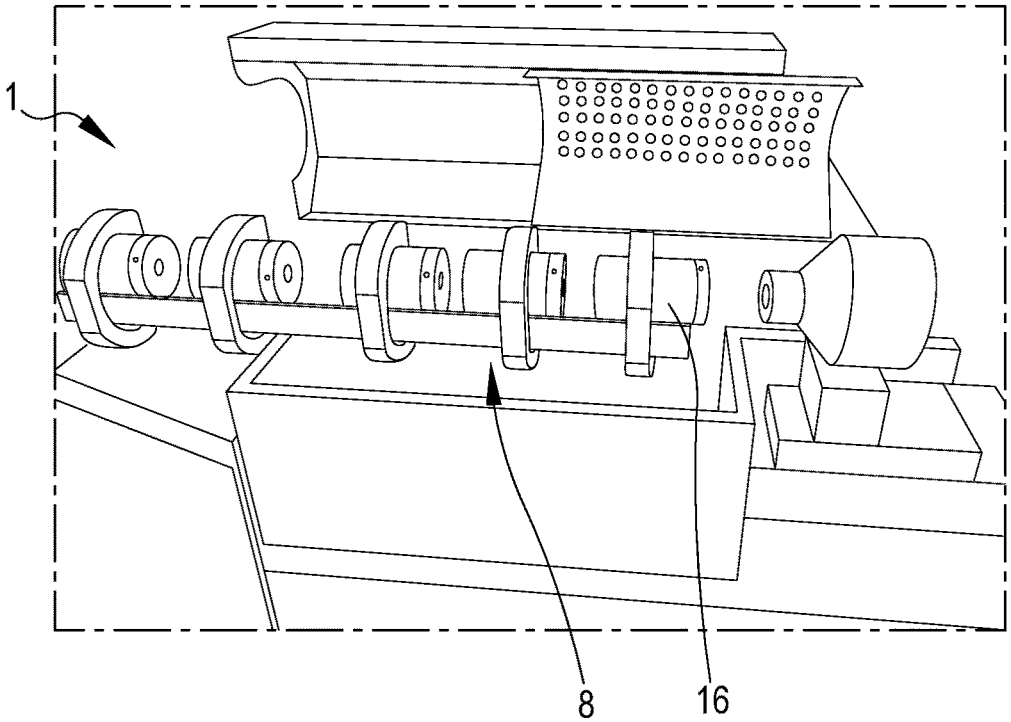
FIG. 3 is a further perspective view of a portion of the apparatus of FIG. 1.
Figure 6:
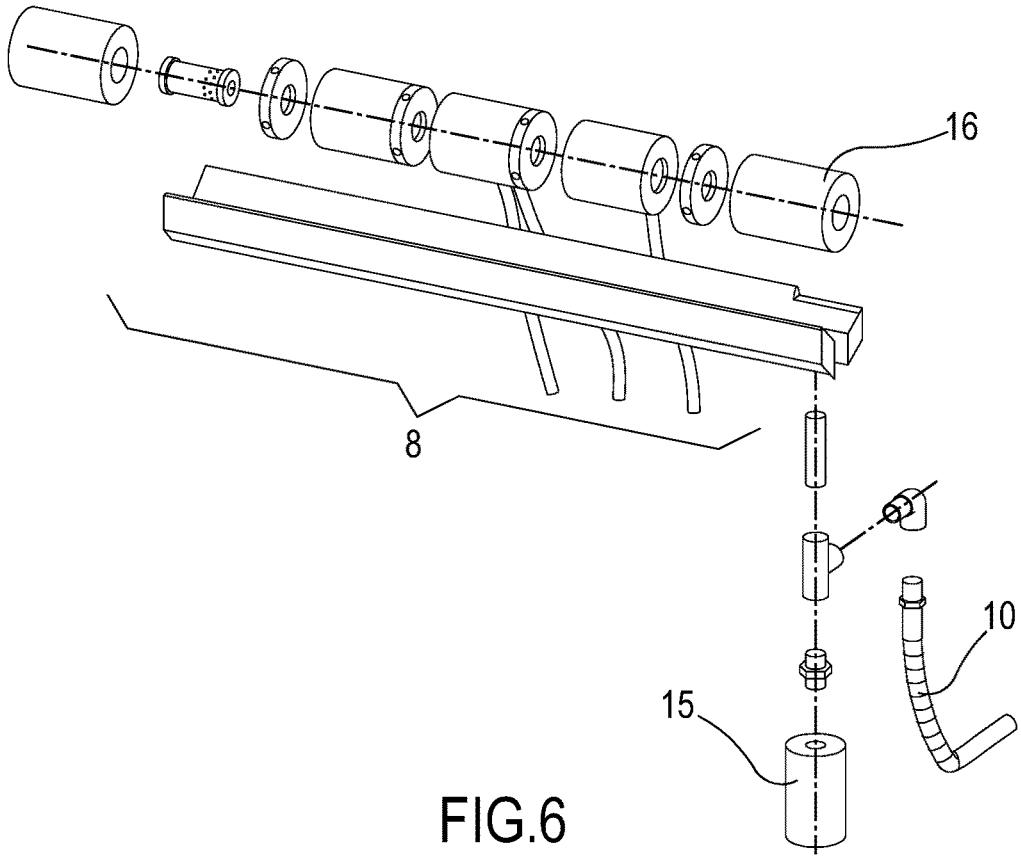
FIG. 6 is a perspective view partially exploded of the element of FIG. 5.

Preferably, the apparatus 1 includes a central unit 100 is adapted to receive signals from the rod forming unit 4 and to command the opening and closing of valve 40. In the embodiment of FIGS. 5 and 6, the tubular element 8 is realized by a plurality of separated elements 16 disposed in series along the feeding direction of the filter material. The first of the separated element 16 in the direction of feed of the filter material is in fluid communication with a condensate chamber 15 which is connected to the portion of through hole 20 of the separated element 16. Preferably, one of the nozzles 11 to eject the steam is also realized in the first of the separated elements 16. In the chamber 15, the condensed fluid is collected. Then, the drain channel 10 departs from the chamber 15, for example from a bottom surface thereof, in order to drain the collected fluid. In this embodiment valve 40 is also present and has the same function as in the embodiment above described.

The invention claimed is:

1. A filter manufacturing apparatus comprising:

a feed path adapted to continuously feed a filter material along a longitudinal transport direction;

a forming device connected to a terminating end of the feed path and adapted to form the filter material into a continuous filter body and to deliver the formed continuous filter body, the forming device including:

a tubular element adapted to allow the filter material to pass therethrough to form the filter tow material into the continuous filter body; and a steam generator adapted to produce steam, the steam generator being in fluid communication with the tubular element to supply steam to the filter material;

a drain channel in fluid communication with the tubular element adapted to drain fluid from the tubular element;

a valve adapted to open and close the drain channel so as to allow or block discharge of fluid from the tubular element.

2. The filter manufacturing apparatus according to claim 1, wherein the tubular element includes an inner peripheral surface adapted to be in contact with the filter material and wherein the drain channel has an end opened in the inner peripheral surface of the tubular element to drain condensed liquid from the interior of the tubular element.

3. The filter manufacturing apparatus according to claim 1, wherein the tubular element includes an inner peripheral surface adapted to be in contact with the filter material and a condensate chamber in fluid communication to the inner peripheral surface, and wherein the drain channel has an end opened in the condensate chamber to drain condensed liquid from the interior of the condensate chamber.

4. The filter manufacturing apparatus according to claim 1, wherein the drain channel includes a second end fluidly connected to a drain tank.

5. The filter manufacturing apparatus according to claim 1, wherein the valve is configured to open and close the drain channel at a predetermined frequency.

6. The filter manufacturing apparatus according to claim 1, wherein the forming device includes a pressure sensor apt to measure a pressure within the tubular element.

7. The filter manufacturing apparatus according to claim 1, wherein the tubular element comprises a plurality of separated tubular elements, the drain channel being in fluid communication with a first of the plurality of separated tubular elements in the longitudinal transport direction of the filter material.

8. The filter manufacturing apparatus according to claim 1, comprising:

a plasticizer addition unit arranged upstream an inlet of the tubular element and adapted to spout a plasticizer to add the plasticizer to the filter material.

9. The filter manufacturing apparatus according to claim 1, wherein the tubular element comprises a tapered portion, so that its internal diameter decreases along the longitudinal transport direction.

* * * * *